US008277069B2

(12) United States Patent
Zuloff

(10) Patent No.: US 8,277,069 B2
(45) Date of Patent: Oct. 2, 2012

(54) ENTERTAINING AND PROMOTIONAL HEAD GEAR

(76) Inventor: Steve Zuloff, Los Angeles County, CA (US)

( * ) Notice: Subject to any disclaimer, the term of this patent is extended or adjusted under 35 U.S.C. 154(b) by 404 days.

(21) Appl. No.: 12/584,961

(22) Filed: Sep. 15, 2009

(65) Prior Publication Data

US 2011/0061145 A1 Mar. 17, 2011

(51) Int. Cl.
*F21V 21/08* (2006.01)

(52) U.S. Cl. ..... 362/105; 362/103; 362/106; 2/209.13

(58) Field of Classification Search ..... 362/103, 362/105; 2/109.13, 209.13
See application file for complete search history.

(56) References Cited

U.S. PATENT DOCUMENTS 2,203,028 A * 6/1940 Parrillo ..... 362/106
2,593,188 A * 4/1952 Rikelman ..... 446/27
D284,268 S 4/1986 Bound
D283,749 S 5/1986 Bound
D287,061 S 12/1986 Bound
5,680,718 A * 10/1997 Ratcliffe et al. ..... 40/329
6,173,447 B1 * 1/2001 Arnold ..... 2/10
D448,527 S 9/2001 Sav
6,500,041 B1 * 12/2002 Crome, Jr. ..... 446/27
6,896,390 B2 * 5/2005 Yu et al. ..... 362/124
6,969,178 B2 11/2005 Zuloff
7,048,403 B2 * 5/2006 Parker et al. ..... 362/103

* cited by examiner

*Primary Examiner* — Anabel Ton
(74) *Attorney, Agent, or Firm* — Howard C. Miskin, Esq.; Gloria Tsui-Yip, Esq.

(57) ABSTRACT

A head gear that provides entertainment and effective advertising with a main body and an attached visor body having an upper portion and a lower portion pivotably connected to each other. The main body fits over or around a wearer's head. The upper portion of the visor body has an area for receiving markings, and along the perimeter of the area is a plurality of light source for illuminating the entire area. A user can make different markings in the area. In an open position, the upper portion is at a substantially right angle relative to the lower portion such that the area with the markings is displayed to a viewer in a forward position. In a closed position, the area is concealed and protected by the lower portion. Use of ultraviolet light emitting diodes and phosphorescent or fluorescent markings provide enhanced entertainment and advertisement value.

25 Claims, 6 Drawing Sheets

ENTERTAINING AND PROMOTIONAL HEAD GEAR

FIELD OF THE INVENTION

The invention relates to an entertaining or promotional wearable device using a light source such as black light. In particular, a head gear with a brim or a visor having an area for marking with a fluorescent or phosphorescent paint and a plurality of ultra-violet light emitting diodes directed towards the area to illuminate the marking on the area to provide an entertaining effect or effective advertising.

BACKGROUND OF THE INVENTION

Ultraviolet (UV) lights encompass lights having wavelengths of 4 to 400 nanometers. The longer wavelengths of the ultraviolet light spectrum are called black light, which have wavelengths slightly shorter than those that are normally visible and is generally safe for human viewing. Black light appears as a deep blue light because only a portion of the light has long enough wavelengths to be visible to human. For the purpose of this invention, blue black lights are simply called black light. An example of a shorter wavelength in the ultraviolet light spectrum is germicidal ultraviolet light that emits a much shorter wavelength that is dangerous to human skin and eyes.

The barely visible and invisible black light energizes fluorescent and/or phosphorescent pigments which then re-emits the light in visible colors. This results in the object appearing to have an independent glow as if internally lit. Black lights have been used as a source of illumination in theatrical productions, amusement park rides and home use for illuminating art covered with fluorescent and/or phosphorescent paint, and for general atmospheric effects for numerous years.

Traditionally, a black light source is generally a tube, similar to a fluorescent tube that produces white light, of a certain length. Traditional black light source is not conveniently portable due to the size and the need of either alternating current or large voltage direct current. While black light has been used to illuminate all sorts of fluorescent or phosphorescent objects, black light as a portable device has been used only more recently. Using light emitting diodes (LEDs) that can produce UV black lights (generally known as UV LED, portable black light devices are developed. UV LEDs are similarly sized as typical prior art LEDs and can be powered by direct current such as batteries.

The inventor's prior "Portable Black Light Device" using UV LEDs is disclosed in U.S. Pat. No. 6,969,178. The '178 patent is a head gear having UV LEDs directed towards and illuminate the wearer's face or the upper portion of the head gear having fluorescent or phosphorescent elements thereon.

Other head gears that provide entertaining values are disclosed in U.S. Pat. Nos. D448,527, D287,061, D283,749, and D283,268. These prior art head gears disclose holders attached to the head gears for receiving beverage cans and straws are incorporated into the head gear for insertion into the beverage cans such that a wearer can consume the beverage while the cans are held in the holders.

SUMMARY OF THE INVENTION

The present invention provides a head gear that has an area for marking with a fluorescent or phosphorescent paint and a plurality of ultra-violet light emitting diodes directed towards the area to illuminate the marking on the area to provide an entertaining effect or effective advertising.

The head gear of the present invention comprises a main body and an attached visor body having am upper portion and a lower portion. The main body fits over or on a wearer's head. The upper portion of the visor body is pivotably attached to the lower portion. The upper portion has an area for receiving markings, and at the outer perimeter of the area is a plurality of UV LEDs directed towards the area to adequately illuminate the entire area. In an open position, the upper portion is at a substantially right angle, vertical position, relative to the lower portion such that the area is displayed to a viewer in a forward position. In a closed position, the area is hidden and the upper and lower portions form the visor of the head gear. The power source and electronic circuitry for powering and controlling the UV LEDs are contained in the visor body.

When in use, the upper portion is in the open position and a fluorescent or phosphorescent marker is used to make markings on the area. With the UV LEDs turned on, the markings on the area will glow brightly, as if internally lit. The area allows any marking thereon to be easily erased for infinite displays and variations.

In a preferred embodiment, the head gear additionally comprises two holders attached to the main body for receiving two beverage cans and two markers, and straws for insertion into the beverage cans. This embodiment further increases the entertaining and promotional values of the head gear.

BRIEF DESCRIPTION OF THE DRAWINGS

Preferred embodiments of the present invention have been chosen for purposes of illustration and description and are shown in the accompanying drawings forming a part of the specification wherein.

DETAILED DESCRIPTION OF THE PREFERRED EMBODIMENTS

Figure 1:
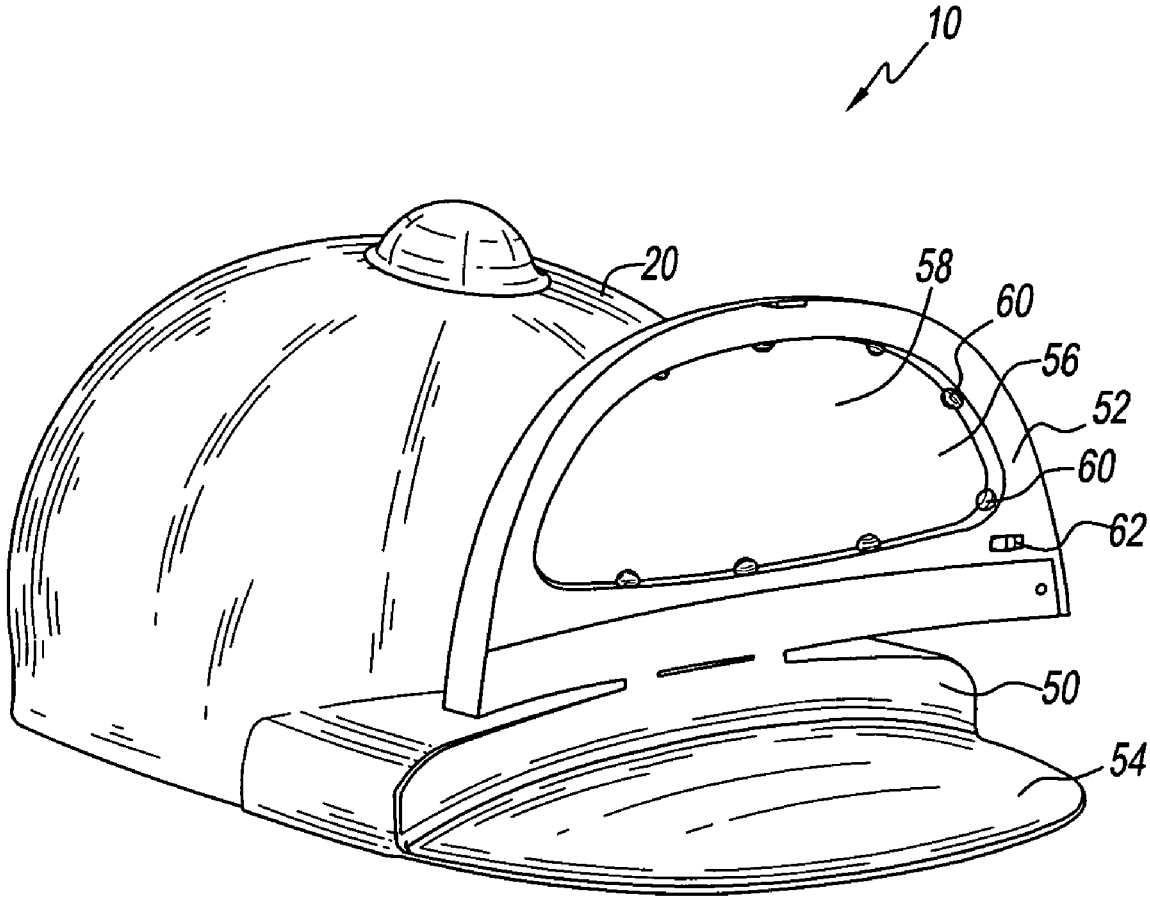
FIG. 1 is a perspective view of the head gear of the present invention with the upper portion of the visor body in the open position.
Figure 2:
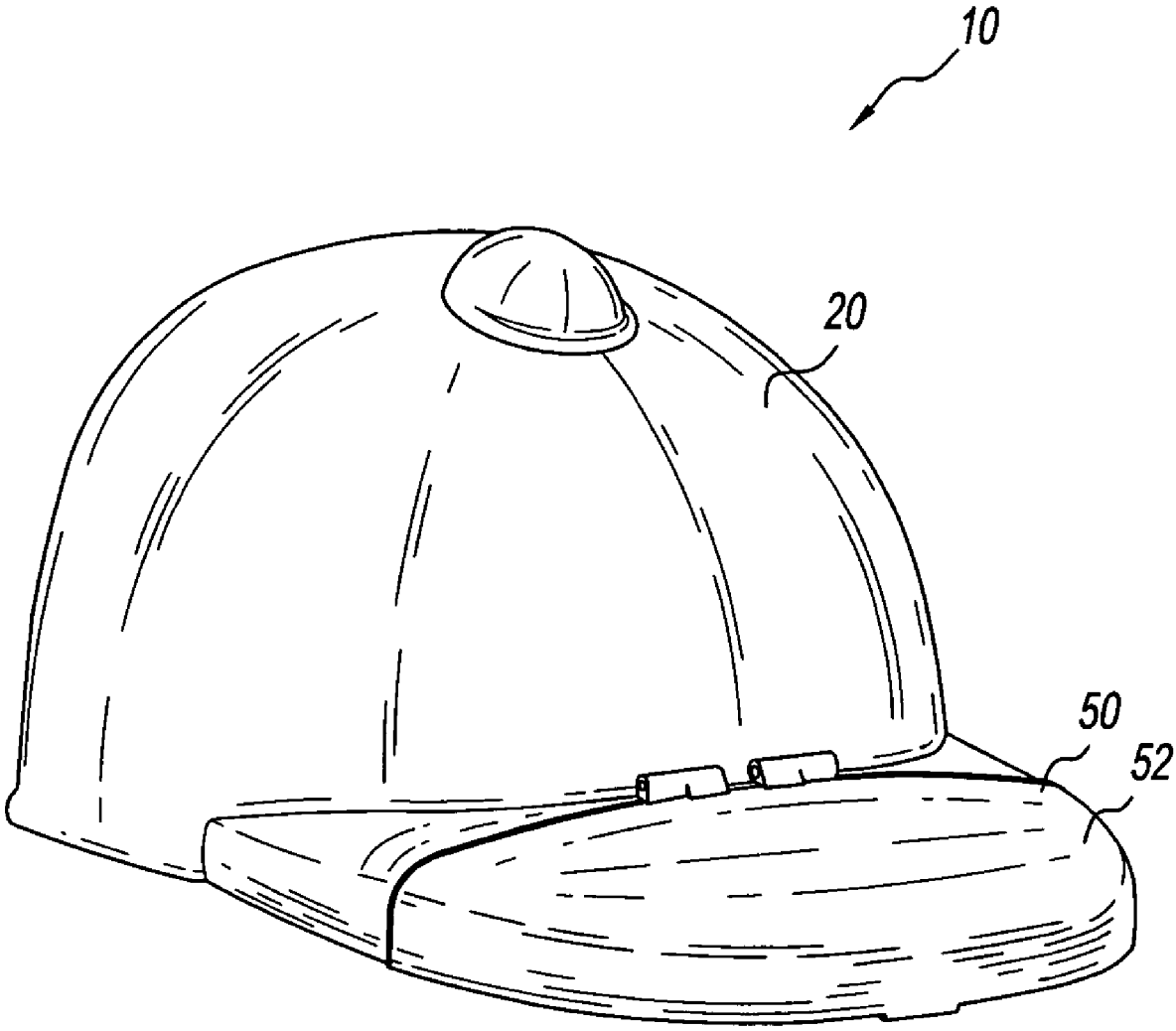
FIG. 2 is the perspective view of the head gear of FIG. 1 with the visor body in the closed position.
Figure 3:
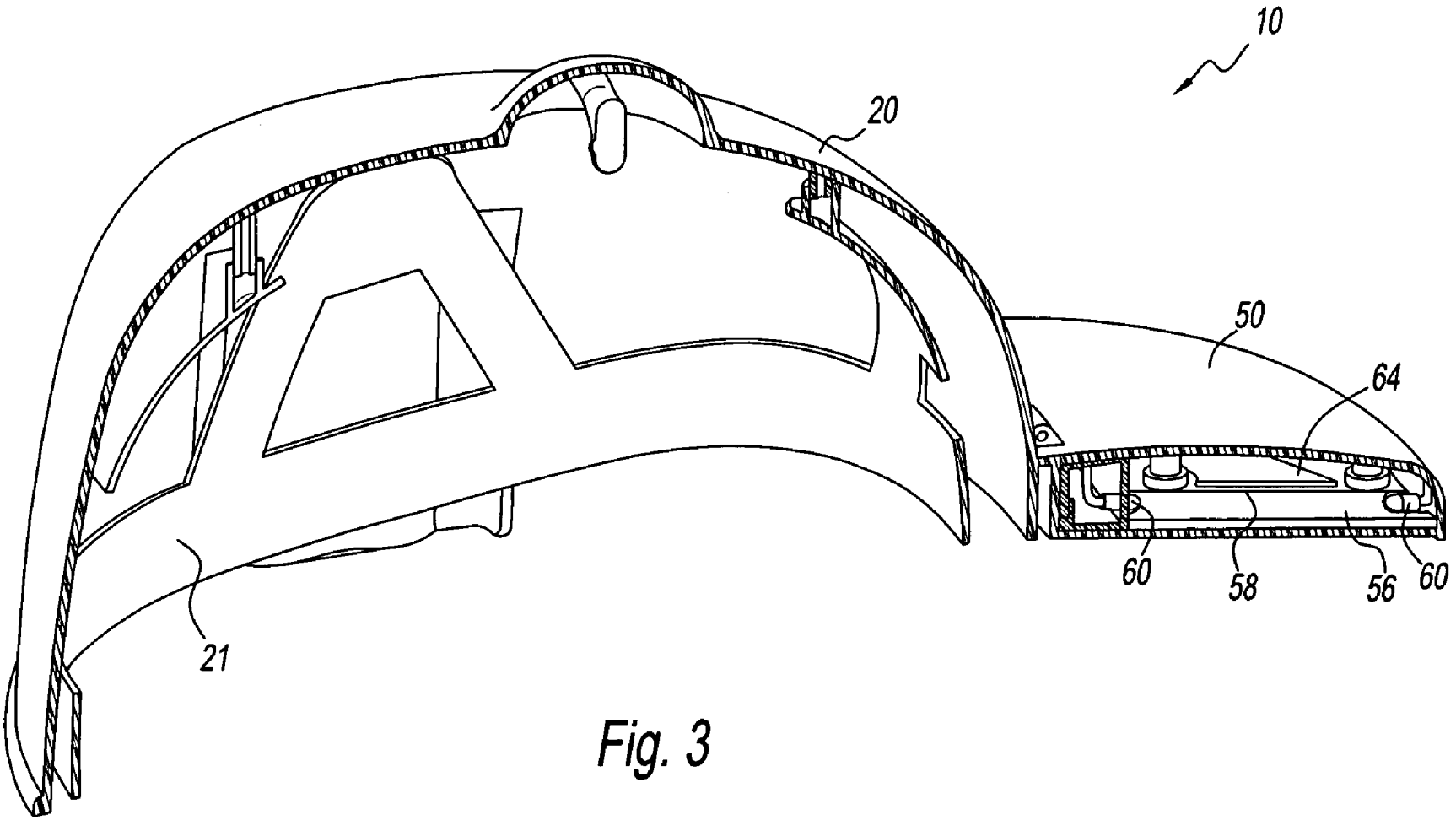
FIG. 3 is a cross sectional view of FIG. 1.

With reference to the drawings, wherein the same reference number indicates the same element throughout, there is shown in FIGS. 1-3 a head gear 10 of the present invention. Head gear 10 comprises a main body 20 and a visor body 50 attached to the main body 10.

As shown in FIGS. 1-3, the main body 20 has a dome (semi-spherical) shape for fitting over or on a wearer's head. The main body 20 can also have other shapes known to one skilled in the art for fitting over or on a wearer's head, such as cube, pyramid, cylindrical, or just a head band or strap for fully or partially encircling a wearer's head. The main body 20 can be made of soft or hard materials, such as fabric, felt, wool, canvas, cardboard, plastic, rubber, silicone, PVC, etc., generally use by one skilled in the art for head gears. To provide additional comfort to a wearer, the main body 20 may include a frame 21 in the inner space of the main body 20 to suspend the main body 20 from the wearer's head. The frame 21 may include a ratchet system to adjust its size to fit different sized head of the wearers.

Attached to the main body 20 is the visor body 50, which extends from the main body 20 in a substantially horizontal plane. The visor body 50 comprises an upper portion 52 and a lower portion 54 that are hingedly or pivotally attached to each other. On the inner surface of the upper portion 52 opposing the lower portion 54 is a depression 56. At the base of the depression 56 is an area 58 for receiving markings. At the perimeter of the area 58, along the wall of the depression 56 are a plurality of LEDs 60 (such as UV LEDs) directed towards the area 58. Other light source (with or without the need of electrical power), such as chemiluminescent element, glow-in-the-dark element, electroluminescence panel, incandescent bulb, fiber optics, etc. can be used instead of LEDs 60. The upper portion 52 also houses the power source, such as batteries (not shown), and electrical circuitry 64 that control the LEDs 60. A control switch 62 is provided on the upper portion 52 to control the LEDs 60. The plurality of LEDs 60 may be turned on (simultaneously, sequentially or at random), blink/flash (simultaneously, sequentially or at random), individually turned on/off sequentially (i.e. chasing/animation), or fading in and out (simultaneously, sequentially or at random). Different sequences in turning on and off the plurality of LEDs 60 can be programmed into the electrical circuitry 64 as known to one skilled in the art. FIG. 1 shows that ten (10) LEDs 60 are used and even spaced from each other to illuminate the area 58. However, more or less LEDs 60 can be used.

The area 58 may contain a removable sheet of paper, a white board or a black board that is made of a magnetizable or plastic material. Other types of material or surface can be used in area 58 as long as markings can be received thereon. Preferably, the area 58 allows markings to be easily erased for infinite variations of markings to be displayed. If the area contains a white or black board, tissues can be used to easily wipe off the markings. To provide maximum entertaining value and effective advertising, the markings can be made with fluorescent or phosphorescent paint such that the markings appear to be internally lit in response to the UV LEDs 60. Additional two- or three-dimensional fluorescent or phosphorescent elements (such as stickers, sculptures) may be provided for a user to attach them to area 58 by any fastening means known to one skilled in the art, such as adhesive, magnet, Velcro®, hook and loop, etc. for even more entertaining value and effective advertising.

When the visor body 50 is in the open position (as in FIG. 1), the upper portion 52 is at a substantially right angle, vertical position, relative to the lower portion 54, such that the area 58 is visible and displayed in a forward position. When the visor body 50 is in the closed position (as in FIG. 2), head gear 10 resembles any other head gear, with the area 58 of the upper portion 52 concealed and protected by the lower portion 54. The upper portion 52 of the visor body 50 is preferably made of a hard plastic material such that it can provide the rigidity to properly position the upper portion 52 with respect to the lower portion 54.

Figure 4:
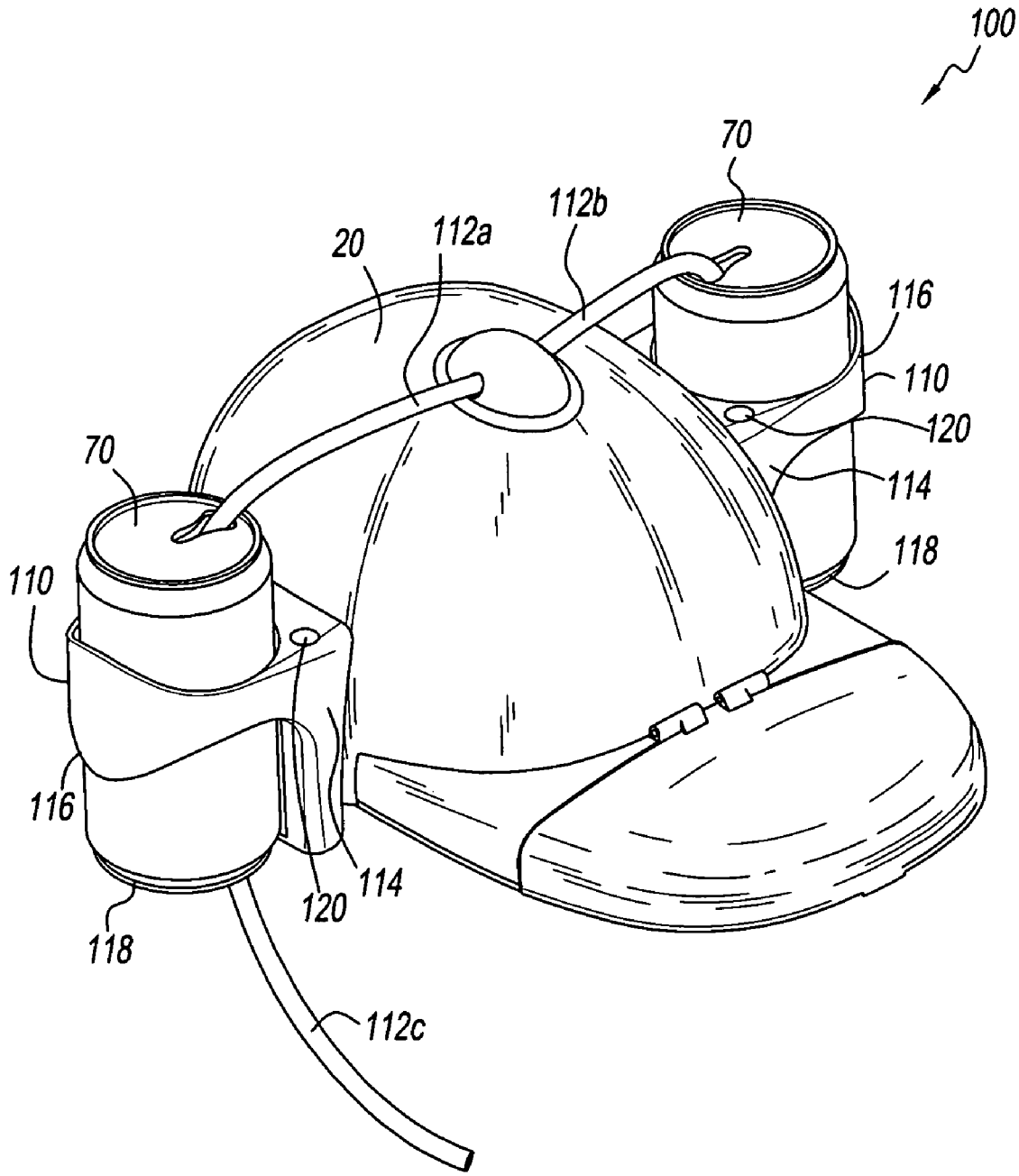
FIG. 4 is a front perspective view of another embodiment of the head gear of the present invention with two holders and straws.
Figure 5:
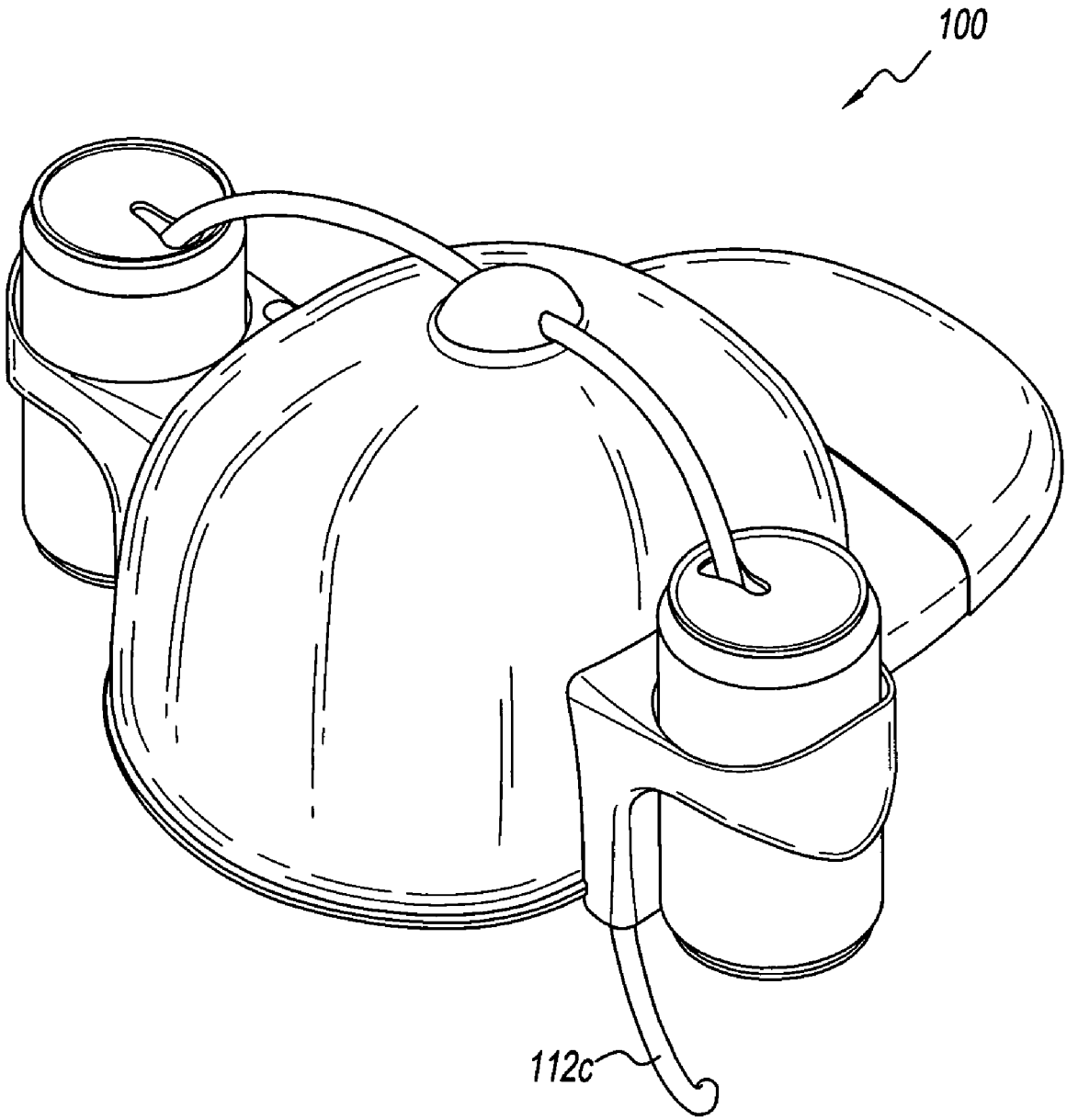
FIG. 5 is the rear perspective view of the head gear of FIG. 4.
Figure 6:
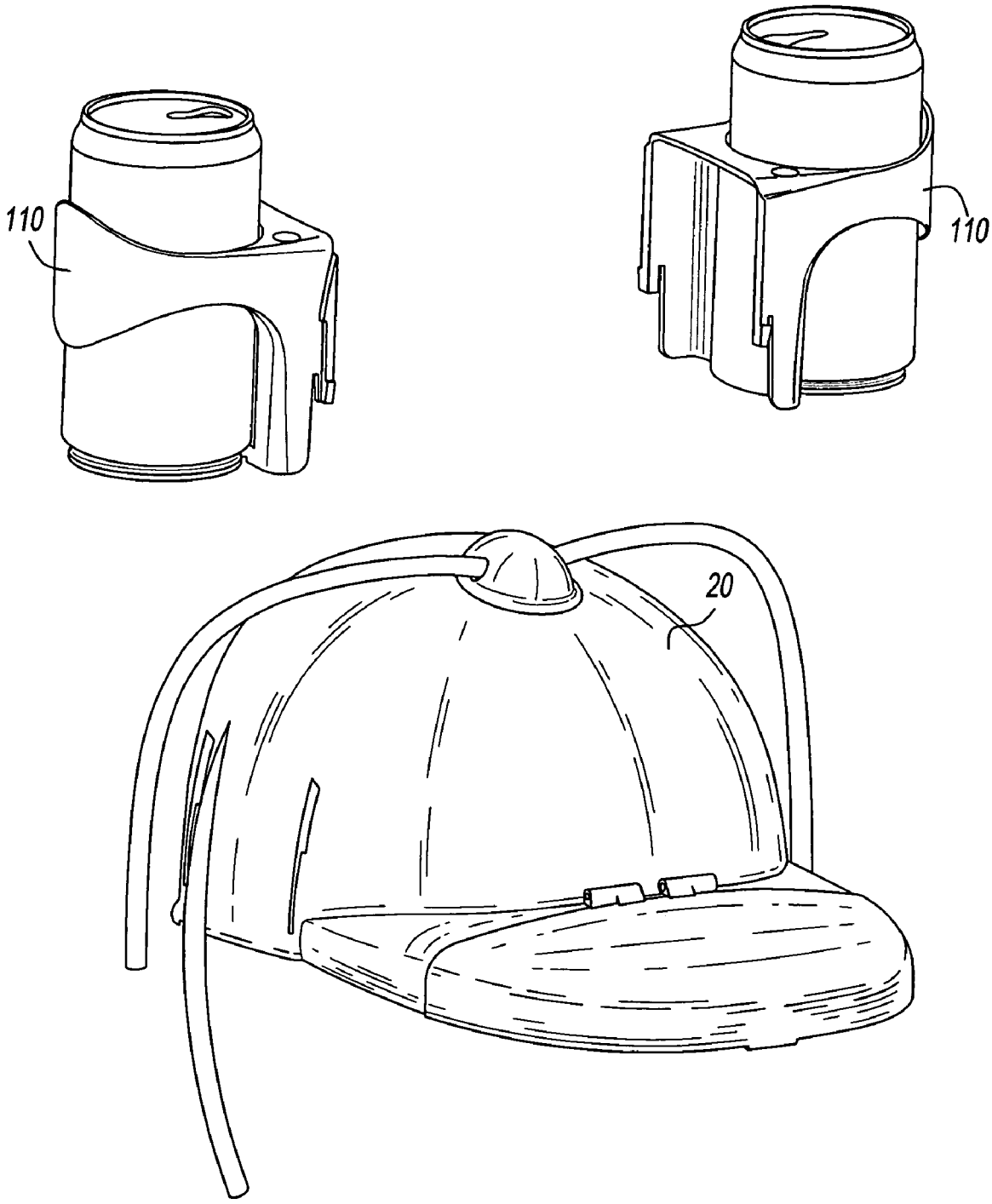
FIG. 6 is the same as FIG. 4, with the holders disconnected from the main body.

FIGS. 4-6 show another embodiment of the head gear 100 that is identical to head gear 10 except that it includes two holders 110 and straws 112 attached to the main body 20. Each holder 110 may be integral with the main body 20 of the head gear 100 or be connected to the main body 20 with a hook and latch system as shown in FIG. 6. Each holder 110 has a frame portion 114, a band portion 116 and a disk portion 118. The band portion 116 is sized to surround a beverage container 70, and the disk portion 118 supports the base of the beverage container 70. The band portion 116 may be adjustable by using Velcro® straps, elastic bands, etc. to accommodate different sized beverage container 70. The frame portion 114 includes a cavity 120 for receiving a writing instrument such as a fluorescent or phosphorescent marker. Two straws 112*a* and 112*b* extend from the main body 20 of the head gear 100, with the distal ends of the two straws 112*a* and 112*b* being inserted into the beverage containers 70. The two straws 112*a* and 112*b* are merged or interconnected within the main body 20 with a T-connector (not shown), which is then connected to a third straw 112*c*. The third straw 112*c* exits the main body 20 via the frame portion 114, such that a wearer can consume the beverage from the beverage cans 70 from the distal end of the third straw 112*c*.

The features of the invention illustrated and described herein are the preferred embodiments. Therefore, it is understood that the appended claims are intended to cover the variations disclosed and unforeseeable embodiments with insubstantial differences that are within the spirit of the claims.

What I claim is:

1. A head gear device for a wearer's head, comprising:

a. a main body adapted to fit the wearer's head; and b. a visor body attached to said main body, said visor body comprises:

i. a lower portion;

ii. an upper portion pivotably connected to said lower portion in an open or closed position, said upper portion having an inner surface with a depression defining an area having a writable media for receiving markings; and iii. at least one light source along the perimeter of said area, wherein each said light source is directed towards said area to illuminate said area when said upper portion is in an open position.

2. The device of claim 1 wherein said light source being a plurality of ultraviolet light emitting diodes.

3. The device of claim 1 wherein said visor body further comprises means for controlling said light source.

4. The device of claim 3 wherein said controlling means being an electrical circuitry.

5. The device of claim 3 wherein said controlling means being a preprogrammed integrated chip.

6. The device of claim 3 wherein said controlling means being an on/off switch.

7. The device of claim 3 wherein said controlling means controls the sequence of illumination of each light source.

8. The device of claim 1 wherein said light source being a plurality of light emitting diodes.

9. The device of claim 1 wherein said writable media being a sheet of paper.

10. The device of claim 1 wherein said writable media being a white board.

11. The device of claim 1 wherein said writable media being a black board.

12. The device of claim 1 wherein said visor body further comprises a power source for energizing each said light source.

13. The device of claim 1 wherein said main body having a three-dimensional shape adapted to fit over a wearer's head.

14. The device of claim 1 wherein said main body having a band adapted to encircle a wearer's head.

15. The device of claim 1 wherein said lower portion and said upper portion are correspondingly sized such that when the lower and upper portions are in a closed configuration, said depression and area are concealed and protected by said lower portion.

16. The device of claim 1 wherein said upper portion is pivotably connected to said lower portion at a maximum angle of about ninety degree from said lower portion in an open configuration such that said area is visible and displayed in a forward position.

17. The device of claim 1 comprising a plurality of light source, wherein said plurality of light source is evenly spaced along said perimeter of said area.

18. The device of claim 1 wherein said area having a writable media made of a magnetizable material.

19. The device of claim 1 further comprising elements adapted to be attached to said area.

20. The device of claim 1 further comprising at least one holder and at least one straw having opposite ends attached to said main body, wherein each of said holder is adapted to receive a beverage container and one each of each of said straw is adapted to be inserted into the beverage container to facilitate consumption of the beverage by the wearer via the opposite end of each of said straw.

21. The device of claim 20 wherein each of said holder comprises a frame portion for attachment to said main body, a band portion extending from said frame portion to surround a beverage container and a disk portion extending from said frame portion to support the base of the beverage container.

22. The device of claim 21 wherein said band portion having means for adjusting its size to fit different beverage containers.

23. The device of claim 21 wherein said frame portion further comprises a cavity adapted to receive a writing instrument.

24. The combination of a head gear device for a wearer's head and at least one fluorescent paint for making markings on said device, comprising:

a. a main body adapted to fit the wearer's head; and b. a visor body attached to said main body, said visor body comprises:

i. a lower portion;

ii. an upper portion pivotably connected to said lower portion in an open or closed position, said upper portion having an inner surface with a depression defining an area for receiving markings;

iii. at least one ultraviolet light emitting diode along the perimeter of said area, wherein each said ultraviolet light emitting diode is directed towards said area to illuminate said area when said upper portion is in an open position; and iv. a power source for energizing each said ultraviolet light emitting diode; and c. at least one fluorescent paint for making markings in said area.

25. The combination of a head gear device for a wearer's head and at least one phosphorescent paint for making markings on said device, comprising:

a. a main body adapted to fit the wearer's head; and b. a visor body attached to said main body, said visor body comprises:

i. a lower portion;

ii. an upper portion pivotably connected to said lower portion in an open or closed position, said upper portion having an inner surface with a depression defining an area for receiving markings;

iii. at least one ultraviolet light emitting diode along the perimeter of said area, wherein each said ultraviolet light emitting diode is directed towards said area to illuminate said area when said upper portion is in an open position; and iv. a power source for energizing each said ultraviolet light emitting diode; and c. at least one phosphorescent paint for making markings in said area.

* * * * *